US007392850B2

(12) United States Patent
Boyd

(10) Patent No.: US 7,392,850 B2
(45) **Date of Patent: *Jul. 1, 2008**

(54) SIDE ENTRY APPARATUS AND METHOD

(76) Inventor: Anthony R. Boyd, 1907 Vida Shaw Rd., New Iberia, LA (US) 70563

( * ) Notice: Subject to any disclaimer, the term of this patent is extended or adjusted under 35 U.S.C. 154(b) by 0 days.

This patent is subject to a terminal disclaimer.

(21) Appl. No.: 11/485,706

(22) Filed: Jul. 13, 2006

(65) Prior Publication Data

US 2007/0137864 A1 Jun. 21, 2007

Related U.S. Application Data

(63) Continuation-in-part of application No. 11/305,055, filed on Dec. 16, 2005.

(51) Int. Cl.
*E21B 19/00* (2006.01)

(52) U.S. Cl. ..... 166/385; 166/242.5

(58) Field of Classification Search ..... 166/242.5, 166/385; 175/74, 51; 285/330
See application file for complete search history.

(56) References Cited

U.S. PATENT DOCUMENTS 3,369,600 A * 2/1968 Bohlmann, Jr. ..... 166/355
4,506,729 A * 3/1985 Davis et al. ..... 166/66.5
RE33,150 E 1/1990 Boyd
5,950,744 A * 9/1999 Hughes ..... 175/320
5,996,712 A 12/1999 Boyd
6,244,345 B1 6/2001 Helms
6,860,525 B2 * 3/2005 Parks ..... 285/391
7,104,345 B2 * 9/2006 Eppink ..... 175/61

* cited by examiner

*Primary Examiner*—Giovanna C Wright
(74) *Attorney, Agent, or Firm*—Robert L. Waddell; Ted M. Anthony

(57) ABSTRACT

An apparatus for lowering wireline into a well. The apparatus comprises a sleeve having a first and second end, wherein the first end contains a first plurality of wedges and the second end contains a second plurality of wedges. The apparatus further includes an upper mandrel having a third plurality of wedges that are configured to engage the first plurality of wedges and a first sub configured to engage the upper mandrel, wherein the upper mandrel contains a first and second passage, and wherein the first passage is configured to receive the wireline. The apparatus further comprises a lower mandrel having a fourth plurality of wedges that engage with the second plurality of wedges, and a second sub configured to engage the lower mandrel, wherein the second sub contains an opening that has the lower mandrel disposed there through.

3 Claims, 8 Drawing Sheets

SIDE ENTRY APPARATUS AND METHOD

This application is a continuation-in-part of U.S. patent application bearing Ser. No. 11/305,055, filed 16 Dec. 2005, entitled "Side Entry Apparatus and Method".

BACKGROUND OF THE INVENTION

This invention relates to a side entry apparatus. More particularly, but not by way of limitation, this invention relates to a side entry apparatus used to channel wireline into a well and a method of use.

During the exploration, drilling, completion and production of hydrocarbons, operators find it necessary to perform wireline work within the well. In most instances, an operator will rig up a lubricator, and wherein the lubricator is attached to the well head. The lubricator is a tubular member that contains a central passage for the conveyance of other concentric tubulars, wireline, electric line, braided line, drilling fluids, completion fluids, etc. The lubricator may contain certain devices such as valves, blow out preventor stacks, swivels, etc. as is well understood by those of ordinary skill in the art.

U.S. Pat. No. RE 33,150 to Boyd describes a side entry tool and is incorporated herein by reference. The side entry tool is a device that can be contained within a lubricator and may contain a central passage for tools, fluid, etc. The side entry tool will also contain a second passage, and wherein the second passage allows entry of a wireline for purposes of conducting wireline operations.

When an operator wishes to rig up a lubricator string, the operator must threadedly make up the connections. A torque is applied via conventional means. However, in the course of applying the torque, some connections may become over torqued. As understood by those of ordinary skill in the art, the application of too much torque can cause damage to the threads, tubular and/or tool, which in turn may lead to failure of the connection and/or tool. The failure may occur at the rotary floor. These types of failures may result in catastrophic effects such as a blowout of the well.

Therefore, there is a need for a device that contains a second passageway. There is also a need for a device that will allow for the proper make up of a lubricator string on a rig. There is also a need for device that will prevent over-torquing of side entry tools. These and other needs will be met by the disclosure herein presented.

SUMMARY OF THE INVENTION

An apparatus for lowering wireline into a well is disclosed. The apparatus comprises a sleeve having a first end and a second end, and wherein the first end contains a first plurality of wedges and a second plurality of wedges. The apparatus further comprises an upper mandrel having a third plurality of wedges that are configured to engage the first plurality of wedges. The apparatus further includes a first cap configured to engage the upper mandrel, wherein the first cap contains a first passage and a second passage, and wherein the first passage is configured to receive the wireline. The apparatus further comprises a lower mandrel having a fourth plurality of wedges that engage with the second plurality of wedges, and a second cap configured to engage the lower mandrel, wherein the second cap contains an opening, and wherein the opening has the lower mandrel disposed there through. In one preferred embodiment, the upper mandrel has a center of axis that is aligned with the center of axis of the sleeve bore. Also, the upper mandrel is configured to provide for a center of pull of the apparatus.

In one preferred embodiment, the apparatus includes thread means on the inner portion of the first cap and thread means on the outer sleeve which cooperate. The apparatus may also comprise thread means on the inner portion of the second cap and thread means on the outer sleeve which cooperate. In one preferred embodiment, the apparatus further includes seal means on the inner portion of the sleeve, a cooperating seal bore on the upper mandrel, seal means on the inner portion of the sleeve, and a cooperating seal bore on the lower mandrel. In the most preferred embodiment, the second passage is configured to receive a kill line means for pumping a fluid into the well. In another preferred embodiment, the second passage is configured to receive a second wireline extending into the well.

A method of performing wireline work on a rig, wherein a well extends from the rig, is also disclosed. The method comprises providing an apparatus comprising: a sleeve having a first second end, wherein the first end contains a first plurality of wedges and the second end contains a second plurality of wedges; an upper mandrel having a third plurality of wedges that are configured to engage the first plurality of wedges; a first cap configured to engage the upper mandrel, wherein the first cap contains a first and second passage, and wherein the first passage is configured to receive the wireline; a lower mandrel having a fourth plurality of wedges that engage with the second plurality of wedges; a second cap configured to engage the lower mandrel, wherein the second cap contains an opening that has the lower mandrel disposed there through. The method further includes providing a wireline through the first passage and into a central bore of the sleeve, and wherein the wireline has a down hole tool attached at a first end, wherein the down hole tool is in the well. The method further comprises lowering the down hole tool on the wireline into the well, transmitting a torque to the upper mandrel, transmitting the torque to the third plurality of wedges and transferring the torque to the first plurality of wedges. In one preferred embodiment, the method further includes terminating the torque to the upper mandrel, transmitting the torque to the lower mandrel, transmitting the torque to the fourth plurality of wedges, transferring the torque to the second plurality of wedges. The method may include pumping a fill fluid through the second passage and into the well.

In a second disclosed embodiment, which is the most preferred embodiment of this application, an apparatus for lowering a wireline into a well is disclosed. The apparatus comprises a sleeve having a first end and a second end, wherein the first end contains a first plurality of wedges and the second end contains a second plurality of wedges. The apparatus includes an upper mandrel having a third plurality of wedges that are configured to engage the first plurality of wedges, wherein the upper mandrel contains a first passage and a second passage, and wherein the first passage is configured to receive the wireline. Also included is a first sub configured to engage the upper mandrel and the sleeve, a lower mandrel having a fourth plurality of wedges that engage with the second plurality of wedges, and a second sub configured to engage the lower mandrel and the sleeve.

The apparatus may further comprise a first thread means on an inner portion of the first sub, and a second thread means on an outer portion of the sleeve which cooperates with the first thread means on the inner portion of the first sub. The apparatus of may further comprise third thread means on an inner portion of the second sub, and fourth thread means on the outer portion of the sleeve which cooperate with the first thread means on the inner portion of the second sub. The apparatus may also include in this most preferred embodiment first seal means on an inner portion of the sleeve and a first seal tubular for sealingly engaging the first seal means. Also included will be second seal means on the inner portion of the sleeve and a second seal tubular for sealingly engaging the second seal means. In the most preferred embodiment, the second passage is configured to receive a kill line means for pumping a fluid into the well.

In the most preferred embodiment, a method of performing wireline work on a rig is disclosed. A well extends from the rig. In this most preferred embodiment, the method comprises providing an apparatus comprising: a sleeve having a first end and a second end, wherein the first end contains a first plurality of wedges and the second end contains a second plurality of wedges; an upper mandrel having a third plurality of wedges that are configured to engage the first plurality of wedges wherein the upper mandrel contains a first passage and a second passage, and wherein the first passage is configured to receive the wireline; a first sub configured to engage the upper mandrel and the sleeve; a lower mandrel having a fourth plurality of wedges that engage with the second plurality of wedges; and, a second sub configured to engage the lower mandrel. The method of this most preferred embodiment further includes providing a wireline through the first passage and into a central bore of the sleeve, and wherein the wireline has a down hole tool attached at a first end, wherein the down hole tool is in the well. The method further includes lowering the down hole tool on the wireline into the well and transmitting a torque to the upper mandrel. The method further includes transmitting the torque to the third plurality of wedges on said upper mandrel and transferring the torque to the first plurality of wedges on the sleeve. The method may further include terminating the torque to the upper mandrel and transmitting the torque to the lower mandrel. Additionally, the method comprises transmitting the torque to the fourth plurality of wedges on the lower mandrel and transferring the torque to the second plurality of wedges on the sleeve. A kill fluid may be pumped through the second passage and into the well if required by the operator.

An advantage of the present invention is that the apparatus will prevent the over torquing of a tubular. Another advantage is that the apparatus can be used as a side entry tool on a rig drilling a well. Yet another advantage is that the invention allows a significant amount of torque be applied to the apparatus without damaging the apparatus. Still yet another advantage is that the apparatus will result in safer connections since the connections will not be over torqued. Another advantage is that the torque is transferred on the outside body.

An advantage of the present invention is that the design allows for less manufacturing cost. Another advantage is that the wedges are located about the circumference of the upper mandrel, the sleeve and the lower mandrel. This allows for more wedges to be included which in turn allows for more torquing ability. Yet another advantage is that the sleeve body can be as long or short as required. Yet another advantage is that the sleeve body has no holes there through. Still yet another advantage is that the passageways can be bored in the upper mandrel from either side (i.e. bored from the outside or bored from the inside), and while boring it is very difficult to damage the upper mandrel.

An advantage of the most preferred embodiment of this application includes the apparatus allows for the wireline tools to be put inside the entry ports while still on the catwalk of a rig due to the tubular connections used. Due to the novel apparatus and tubular connection, an operator can attach one sinker bar to the rope socket to be installed safely. While using multiple wirelines, the operator has a choice of which wireline to be used without changing out the safety tools. This will prevent personnel from having to ride a belt up in the derrick to install the wireline tools. Yet another advantage is that the apparatus also allows for a direct, straight full pulling capacity on the workstring. The apparatus has a service connection in the body, which no other prior art device contains. With the new pin torque connections, internal inspections can be done on the equipment. In the past, the only way to inspect internally was to destroy the equipment (half cuts).

A feature of the present invention includes the torque shoulders on the sleeve will engage and cooperate with torque shoulders on the mandrel. Another feature is that the torque is applied only to the torque shoulders. Another feature is that multiple apertures may be provided on the upper cap for multiple entry points for multiple wirelines, kill lines, etc. Yet another feature is that the central passage can contain a large flow through bore. Yet another feature is that the wireline will pass on the inside of the seal o-rings and torquing areas. Still yet another feature includes the ability to center pull on the mandrel while the apparatus is in use on a rig floor. Yet another feature is the seal means contain the pressure from the well.

A feature of the present application is that you can turn the sleeve upside down and still be usable. In other words, the either end of the sleeve can be used as the top end. Another feature of the present invention is the seal means is completely shielded by the seal collars. Still yet another feature is that the grooves for placement of the seal means are on the inner surface portion of the apparatus. Yet another feature is that there is no need to align the passages on the upper mandrel with the bore of the sleeve. Yet another feature is that the wedges are easy to manufacture.

DETAILED DESCRIPTION OF THE PREFERRED EMBODIMENTS

Figure 1:
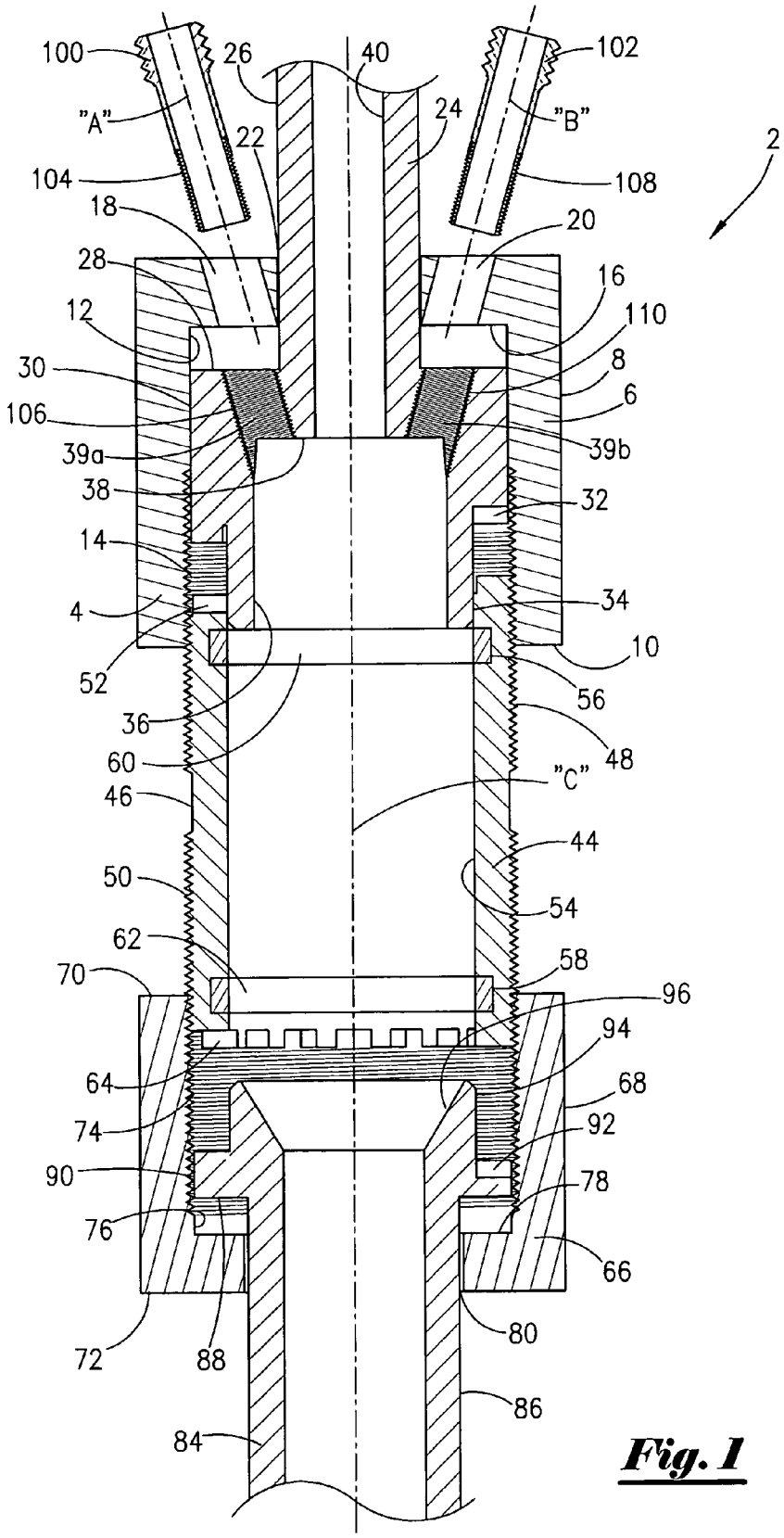
FIG. 1 is a partially exploded cross-sectional view of the most preferred embodiment of the present invention.

Referring now to FIG. 1, a partially exploded cross-sectional view of a preferred embodiment of the present invention will now be described. More specifically, the apparatus 2 includes a first cap 4, wherein the first cap 4 includes a cylindrical body 6 that has an outer cylindrical surface 8 that extends to the radial end 10, and wherein the radial end 10 in turn extends to the inner diameter surface 12. The inner diameter surface 12 includes the inner thread means 14, and wherein the inner diameter surface 12 extends to the end surface 16. As shown in FIG. 1, the end surface 16 has two (2) passages bored there through, namely passage 18 and passage 20. The center axis for passage 18 is shown as "A" and the center axis for passage 20 is shown as "B". Passages 18, 20 are configured at an angle relative to the center axis "C" of the first cap 4. FIG. 1 further depicts a center opening 22, and wherein a mandrel 24 is disposed within center opening 22. As seen in FIG. 1, the line "C" also serves as the center of axis for the mandrel 24 (i.e. sharing of the center axis "C).

The mandrel 24 comprises a generally cylindrical outer surface 26 that extends to a radial surface 28 which in turn extends to the outer cylindrical surface 30. The outer cylindrical surface 30 terminates at the plurality of wedge members 32, which in turn extends to the outer cylindrical surface 34. The mandrel 24 contains an inner diameter portion 36 which extends to the radial surface 38, and wherein the radial surface 38 contains the passages 39*a*, 39*b* that are aligned with the passages 18, 20. The radial surface 38 extends to the inner diameter surface 40.

The sleeve 44 contains an outer cylindrical surface 46, and wherein the outer cylindrical surface 46 contains the outer thread means 48 as well as the outer thread means 50. The outer thread means 48 will cooperate and mate with the inner thread means 14. The thread means 48 extend to the plurality of wedge members 52, and wherein the wedge members 52 cooperate and engage with the wedge members 32. The term wedges, in the most preferred embodiment, refers to square teeth type of protrusions that will cooperate and engage with a set of complimentary teeth. In one embodiment, the wedges may be a torque shoulder that transfers torque to a complimentary torque shoulder.

The sleeve 44 contains an inner diameter surface 54 that contains a first groove 56 and a second groove 58, and wherein the first groove 56 contains a v-packing element (seal means 60) and the second groove 58 contains a v-packing element (seal means 62). An o-ring type of seal means could also be used. The seal means 60 will sealingly engage with the outer cylindrical surface 34. The sleeve 44 further comprises at a radial end, the plurality of wedge 64.

In the most preferred embodiment, the apparatus 2 further comprises a second cap 66 that includes an outer cylindrical surface 68. The second cap 66 contains a first radial end 70 and a second radial end 72. Extending radially inward from the first radial end 70 is the internal thread means 74 that will cooperate and engage outer thread means 50. The second cap 66 includes the inner diameter surface 76 which extends to the radial surface 78, and wherein the radial surface 78 contains the opening 80.

The apparatus 2 further comprises mandrel 84 that includes the outer cylindrical surface 86. The outer cylindrical surface 86 extends to the radial shoulder 88 which stretches to the outer surface 90. The mandrel 84 contains a plurality of wedges 92, and wherein the wedges 92 will cooperate and engage with the wedges 64. The wedges 92 has extending therefrom the outer cylindrical surface 94. Extending radially inward from the outer cylindrical surface 94 is the inner chamfered surface 96. The outer cylindrical surface 94 will cooperate and sealingly engage with the seal means 62.

As seen in FIG. 1, a wireline guide sub 100 is provided for passages 18 and 39*a*, while the wireline guide sub 102 is provided for passages 20 and 39*b*. The wireline guide sub 100 contains the external thread means 104 for engagement with the internal thread means 106 within the passage 39*a* of mandrel 24. The wireline guide sub 102 contains the external thread means 108 for engagement with the internal thread means 110 within the passage 39*b* of mandrel 24.

Figure 2:
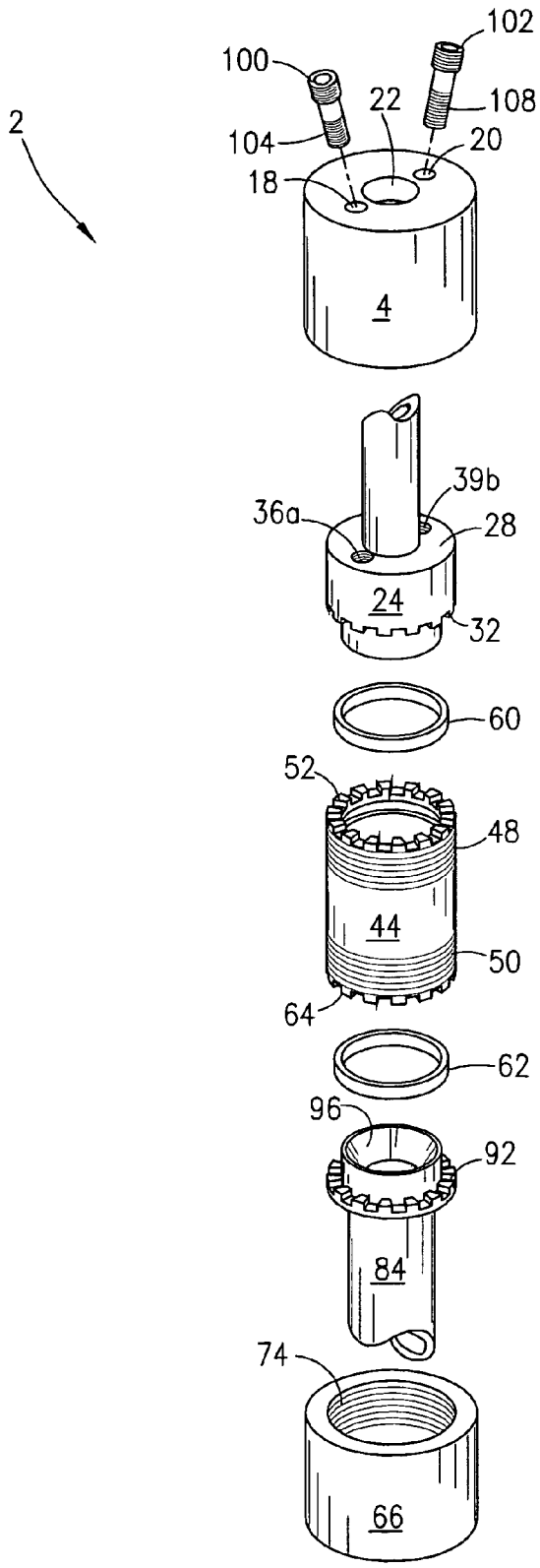
FIG. 2 is a fully exploded view of the cross-sectional embodiment seen in FIG. 1

Referring now to FIG. 2, a fully exploded view of the cross-sectional embodiment seen in FIG. 1 will now be described. It should be noted that like numbers appearing in the various figures refer to like components. FIG. 2 shows the teeth like projections of the wedges, for instance wedges 32, 52, 64, 92. Also shown is the first cap 4 and the second cap 66. The mandrel 24 is shown, and wherein mandrel 24 will cooperate with the cap 4 and the sleeve 44. the mandrel 84 will cooperate with the sleeve 44 and cap 66, as previously described.

Figure 3:
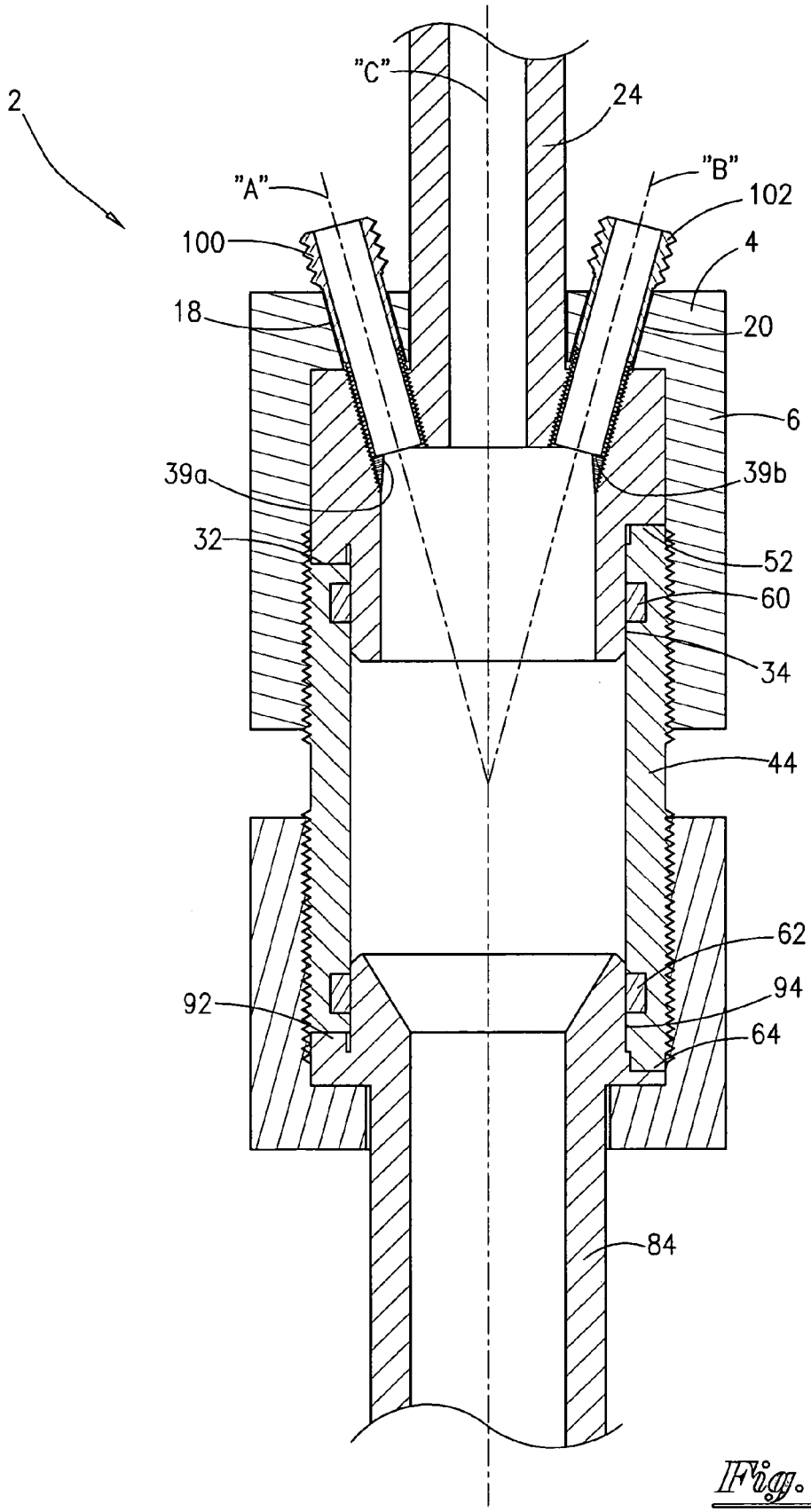
FIG. 3 is a cross-sectional assembled view of the embodiment depicted in FIG. 1

FIG. 3 is a cross-sectional assembled view of the apparatus 2 depicted in FIG. 1. Therefore, FIG. 3 depicts the first cap 4 that has the cylindrical body 6. The mandrel 24 is disposed within the first cap 4, and wherein the wedges 32 are shown cooperating and engaging with the reciprocal wedges 52. In this way, a torque applied to the mandrel 24 or the sleeve 44 will be transferred to the reciprocal wedge profiles. Also, the first cap 4 holds the two together (mandrel 24 and sleeve 46), and keeps the wedges locked in place.

Also seen in FIG. 3 is the wedges 64 which are cooperating and engaging with the wedges 92 of the mandrel 84, and wherein a torque applied to the mandrel 84 will be transferred to the wedge profiles. FIG. 3 further depicts the outer cylindrical surface 34 sealingly engaging with the seal means 60, and the outer cylindrical surface 94 sealingly engaging with the seal means 62. FIG. 3 further depicts the center line "A" through passage 18 and into the inner portion of the sleeve 44, the center line "B' through passage 20, and the center line "C" through the bore of mandrel 24 and sleeve 44. It should be noted that in the case of pull force on the mandrel 24, the center of the pull force will be exerted on the mandrel about the center line "C". This is important because if an operator requires an axial pull force on the apparatus 2, the apparatus 2 will be balanced and the pull force can be distributed along the length of the mandrel 84.

Figure 4:
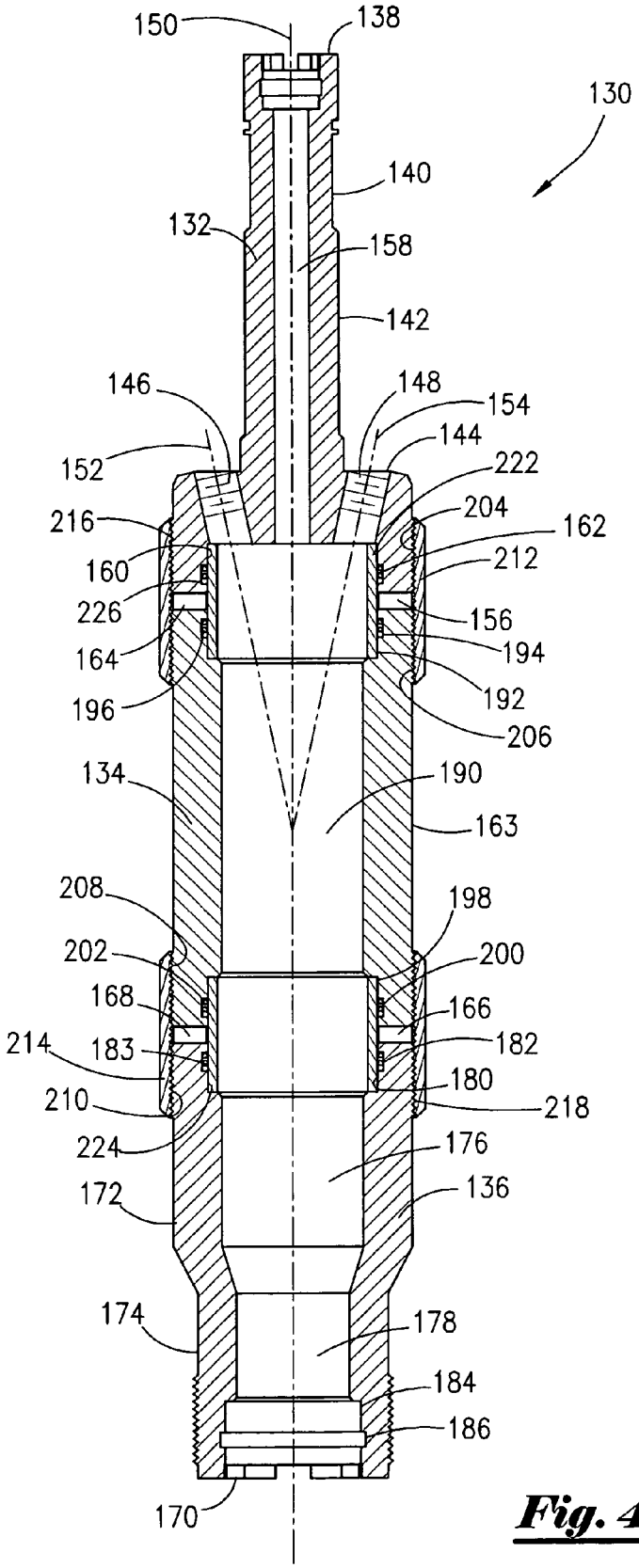
FIG. 4 is a cross-sectional view of the most preferred embodiment of the present apparatus.

Referring now to FIG. 4, a cross-sectional view of the most preferred embodiment of the present apparatus 130 will now be described. The apparatus 130 includes an upper mandrel 132 that extends to the sleeve 134. The sleeve 134 will then extend to the lower mandrel 136.

More specifically, the upper mandrel 132 contains a first end that has a plurality of wedge members 138 (sometimes referred to as torque shoulders). The upper mandrel 132 extends to a first outer surface 140 which in turn extends to the second outer surface 142. The upper mandrel 132 contains the radial surface 144, and wherein the radial surface 144 contains the first passage 146 and the second passage 148.

FIG. 4 also depicts the center of axis line 150 that represents the center of the bore of the apparatus 130. Also, the center of axis line 152 represents the center of the passage 146 and the center of axis line 154 that represents the center of the passage 148. The second end of the mandrel 132 will contain a plurality of wedge members, seen generally at 156.

The upper mandrel 132 contains a first internal bore 158 that extends to the second enlarged bore 160. The enlarged bore 160 will have a groove 162 for placement of a seal means, as will be more fully explained.

The sleeve 134 is generally a cylindrical member having an outer surface 163, and wherein the sleeve 134 has a first end that contains a plurality of wedge members, seen generally at 164, and a second end that contains a plurality of wedge members, seen generally at 166.

FIG. 4 further depicts the lower mandrel 136 that has an upper plurality of wedges, seen generally at 168, as well as a lower plurality of wedges, seen generally at 170. The lower mandrel 136 contains a first outer surface 172 that extends to a second outer surface 174. The lower mandrel 136 contains a first internal bore 176 that extends to a second internal bore 178. The first internal bore 176 has an indented portion 180, and wherein the indented portion 180 contains a groove 182 for placement of a seal means, such as an o-ring 183. The second internal bore 178 also contains the indentation 184, and wherein the indentation 184 contains the groove 186, also for placement of a seal means (not shown).

The sleeve 134 has an inner bore surface 190, and wherein the inner bore surface 190 has an indented surface 192 and a groove surface 194. The groove surface 194 will contain a seal means, such as the o-ring 196. Additionally, the inner bore surface 190 contains the indented portion 198 that contains the groove 200, and wherein the groove 200 will contain the seal means, such as o-ring 202.

FIG. 4 also depicts the outer thread means 204 on the upper mandrel 132. The sleeve 134 has the outer thread means 206 and the outer thread means 208. Further, the lower mandrel 136 contains the outer thread means 210. The apparatus 130 includes the sub 212 and the sub 214, and wherein the sub 212 contains the internal thread means 216 and the sub 214 contains the internal thread means 218. Hence, the internal thread means 216 will engage and cooperate with the external thread means 204 and the external thread means 206. The internal thread means 218 will cooperate and engage with the external thread means 208 and the external thread means 210.

FIG. 4 also shows the seal collar 222 and the seal collar 224. The seal collar 222 is operatively associated with the upper mandrel 132 and the top portion of the sleeve 134, and more specifically with the seal means 226 and the seal means 196. The seal collar 224 is operatively associated with the sleeve 134 and the lower mandrel 136, and more specifically with the seal means 202 and the seal means 183.

Figure 5:
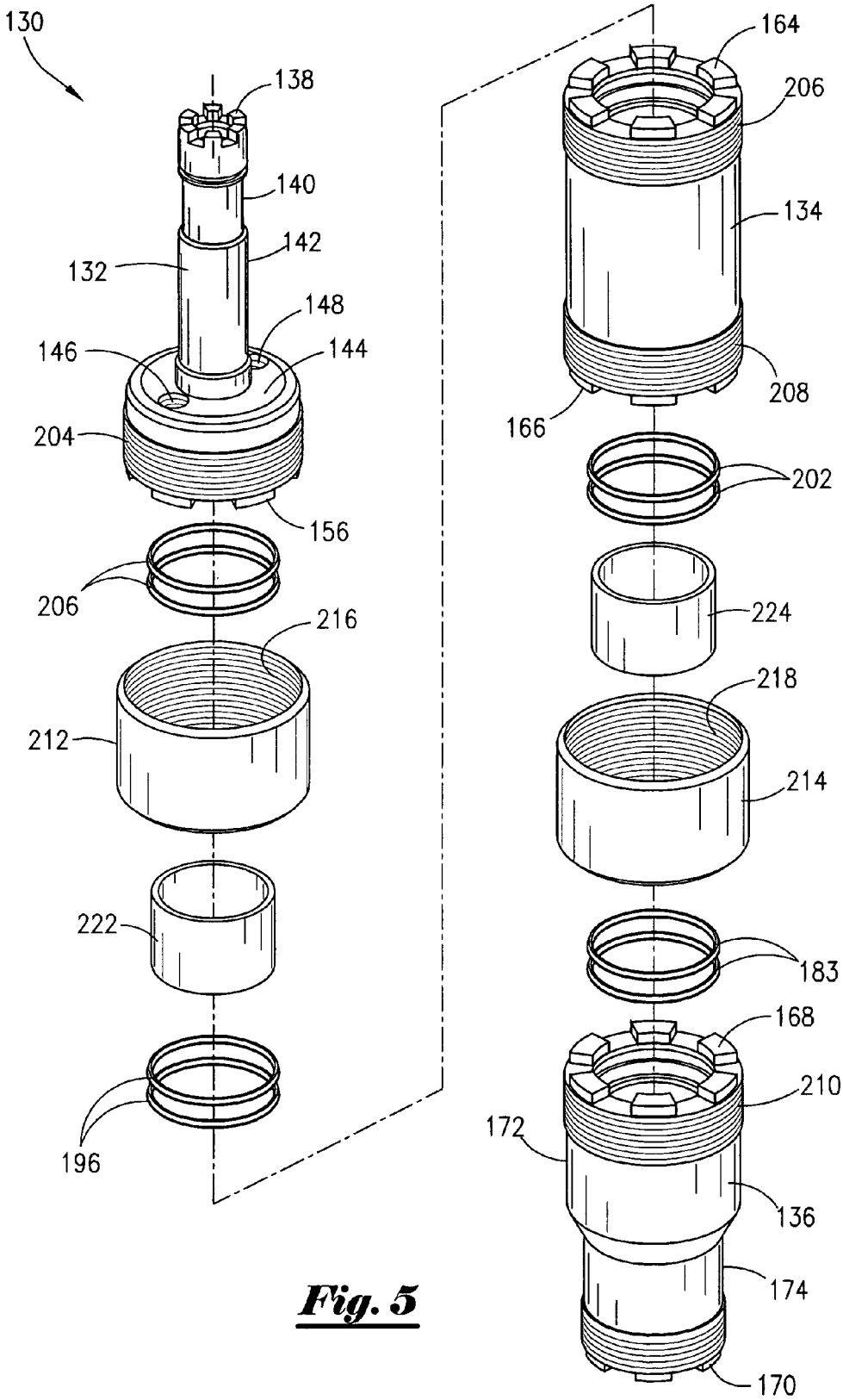
FIG. 5 is an exploded perspective view of the most preferred embodiment seen in FIG. 4.

Referring now to FIG. 5, an exploded perspective view of the most preferred embodiment seen in FIG. 4 will now be described. As noted earlier, like numbers appearing in the various figures refer to like components. Hence, the sub 212 will threadedly engage with the outer threads 204 and 206. The sub 214 will threadedly engage with the outer threads 208, 210. Also, the seal collar 222 will cooperate and engage with the o-rings 226 and the seal collar 224 will cooperate and engage with the o-rings 202 and 183. In this way, pressure within the inner bore 190 will be prevented from escaping.

It should be noted that the wedge members 138 on the upper mandrel 132 and the wedge members 170 on the lower mandrel 136 are configured to engage and cooperate with a reciprocal set of wedge members on an adjoining tubular so that the apparatus 130 can be connected to the adjoining tubular. A tubular connection and method was disclosed in patent application Ser. No. 11/127,919, filed on 12 May 2005, entitled "Tubular Connection and Method", and incorporated herein by express reference as well as a continuation in part application bearing patent application Ser. No. 11/229,919, filed 19 Sep. 2005, entitled "Tubular Connection and Method" and incorporated herein by express reference.

Figure 6:
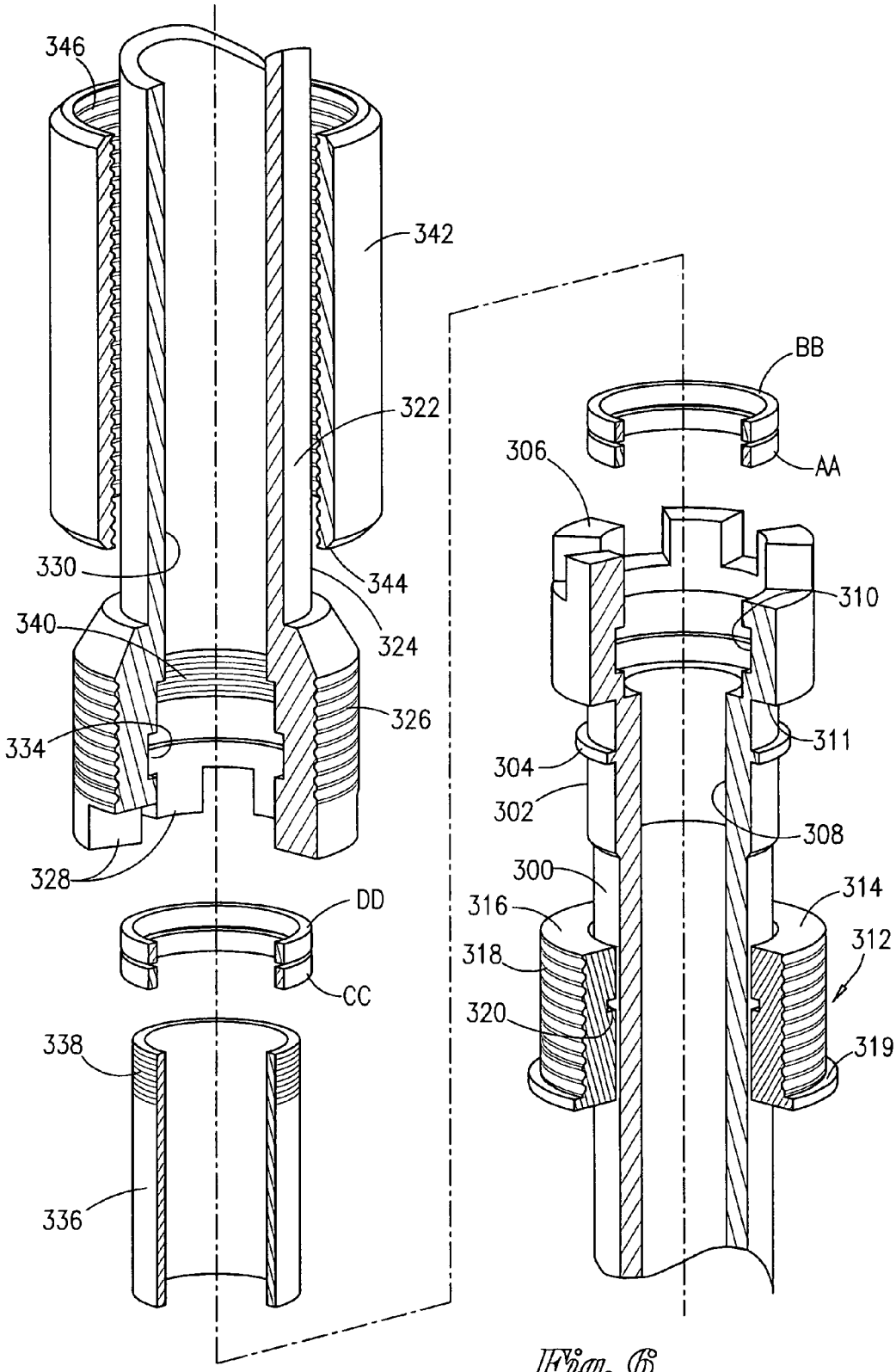
FIG. 6 is a disassembled partial cross-sectional perspective view of a tubular connector embodiment used with the described side entry apparatus of the present disclosure.

FIG. 6 illustrates a disassembled partial cross-sectional perspective view of a second preferred embodiment of the tubular connector used with the side entry apparatus of the present disclosure. The embodiment of FIG. 6 is the most preferred tubular connection embodiment of this application. A first tubular 300 is provided, wherein the first tubular 300 has an outer surface 302. The outer surface 302 contains an annular ring 304. The first tubular 300 has at one end the protruding wedges 306. The first tubular 300 further contains an inner bore surface 308, and wherein the inner bore surface 308 extends to the expanded recess seen generally at 310 for placement of seal means (such as o-rings) AA, BB. Another shoulder 311 is provided on first tubular 300, which will provide for load distribution when the tubular connection is undergoing tensional or compressional forces.

FIG. 6 depicts the sub 312 that will be disposed about the first tubular 300. More specifically, the sub 312 contains a first half section 314 and a second half section 316, and wherein both half sections 314, 316 are mirror images in the most preferred embodiment. The outer portion of the sub 312 contains the outer threads 318, and wherein the outer threads are the same type of threads previously described, namely a standard acme type of thread having two (2) threads per inch. The outer threads 318 extend to the radial shoulder 319. The sub 312 contains an inner portion and wherein the inner portion contains a radial groove 320, and wherein the radial groove 320 will cooperate with the annular ring 304 so that the sub 312 will be captured on the first tubular 300.

The second tubular 322 is depicted in FIG. 6, and wherein the second tubular 322 has an outer surface 324 that extends to a second outer surface, namely the outer threads 326. The second tubular 322 forms an extension (i.e. integrally formed) of the lower mandrel 136 in this embodiment. The outer threads 326 are the same type of threads previously described, namely a standard acme type of thread having two (2) threads per inch. The bottom end of second tubular 322 includes the protruding wedges 328, and wherein the protruding wedges 328 and the protruding wedges 306 will cooperate to engage. The second tubular 322 contains an inner portion 330 which in turn extends to the expanded recess 334 for placement of a seal assembly CC, DD (which may be o-rings in one preferred embodiment), as will be described in greater detail later in the application.

The seal sleeve 336 contains an outer cylindrical surface that is adapted for insertion into the inner bores of the second tubular 322 and the first tubular 300. The seal sleeve 336 contains outer threads 338 that will engage with the internal threads 340 contained within the second tubular 322. FIG. 6 also depicts the outer shell 342, wherein the outer shell 342 has an outer surface that extends to the radial end 344. Extending radially inward is the inner threads 346 that will cooperate and engage with the outer threads 326 and 318, and wherein the inner threads are the same type of threads previously described, namely a standard acme having two (2) threads per inch.

Figure 7:
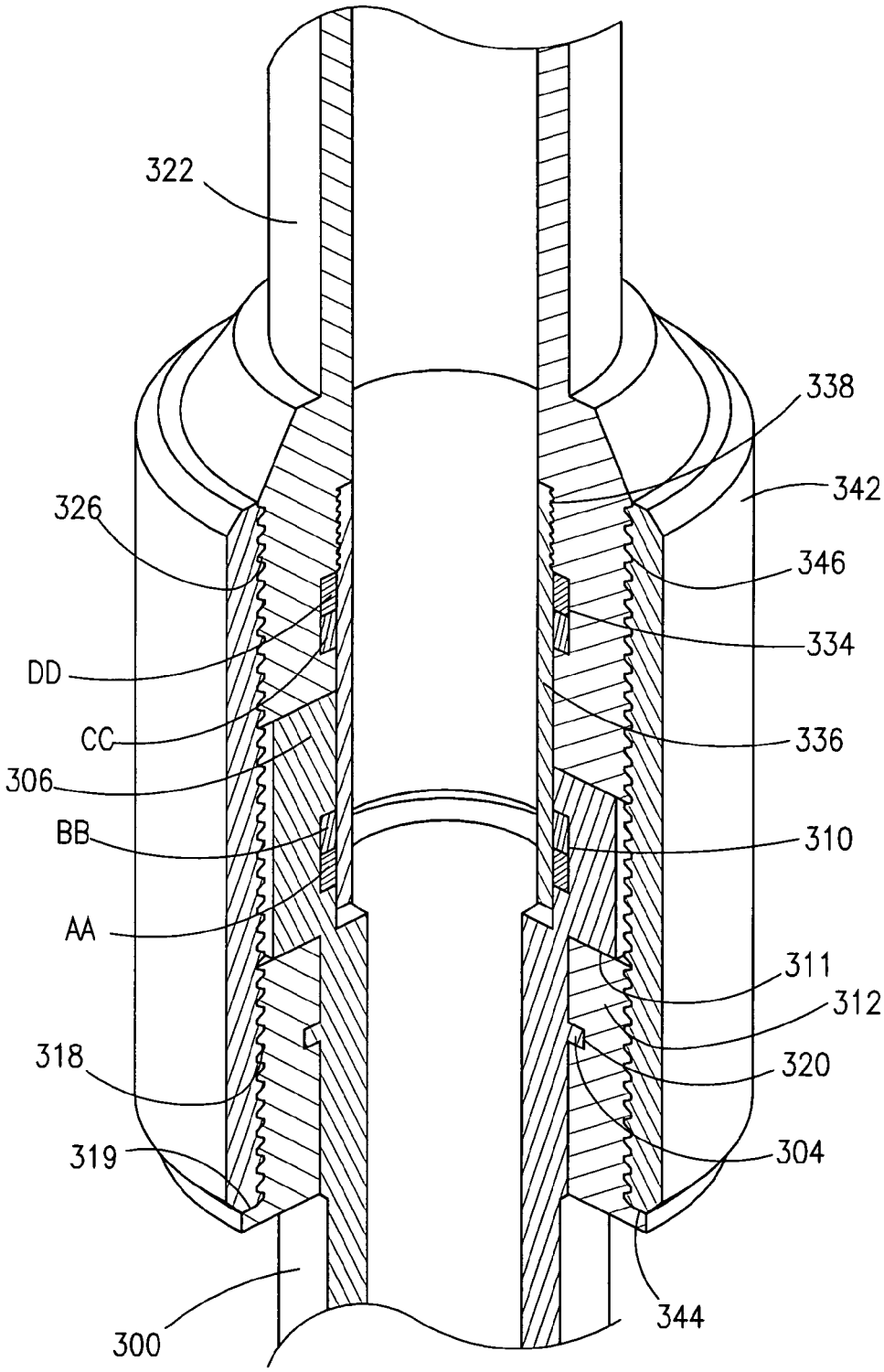
FIG. 7 is an assembled partial cross-sectional perspective view of the tubular connector illustrated in FIG. 6.

Referring now to FIG. 7, the assembled partial cross-sectional perspective view of the tubular connector illustrated in FIG. 6 will now be described. More specifically, the first tubular 300 and the second tubular 322 have been engaged via the protruding wedges 306, 328 (wedge 328 not seen in this view). The sub 312 is in place about the first tubular 300 and wherein the annular ring 304 of the first tubular 300 is engaging the radial groove 320 of sub 312. The outer shell 342 has been screwed into place as shown in FIG. 7; hence, the inner threads 346 have engaged the outer threads 326 and 318. Sub 312 will allow the receptacle wedges to be put in place at any turn since the sub 312 can be rotated about the annular ring 304. In other words, with the design of sub 312, there is no lining up the outer threads to make up the outer nut 342 to the sub 312, the operator can simply rotate sub 312 until the outer threads form a continuous thread pattern relative to the inner threads 346 as seen in FIG. 7.

FIG. 7 further depicts the continuous spiral thread pattern of the invention, and more specifically, the continuous spiral thread pattern formed when outer threads 326, 318 are coupled with the outer shell 342 via inner threads 346. The radial end 344 engages the radial shoulder 319. The seal assembly AA, BB is positioned within the recess 310 and the seal assembly CC, DD is positioned within the recess 334. Therefore, with the seal sleeve 336 in place and threadedly engaged with the second tubular 322, internal pressure will be prevented from escaping into the outer areas, as will be appreciated by those of ordinary skill in the art. In the event that the operator wishes to rotate either the first tubular 300 and/or the second tubular 322, the rotation force (torque) will be transferred to the wedges. A pull force will be transferred to the external threads 326, internal threads 346, then to the external threads 318, and to shoulder 311 via the top portion of half sections, in accordance with the teachings of the present invention. A compressional force will transfer against external threads 326, then to internal threads 346, then to external threads 318 and the top portion of half section 314, 316 via shoulder 311.

Figure 8:
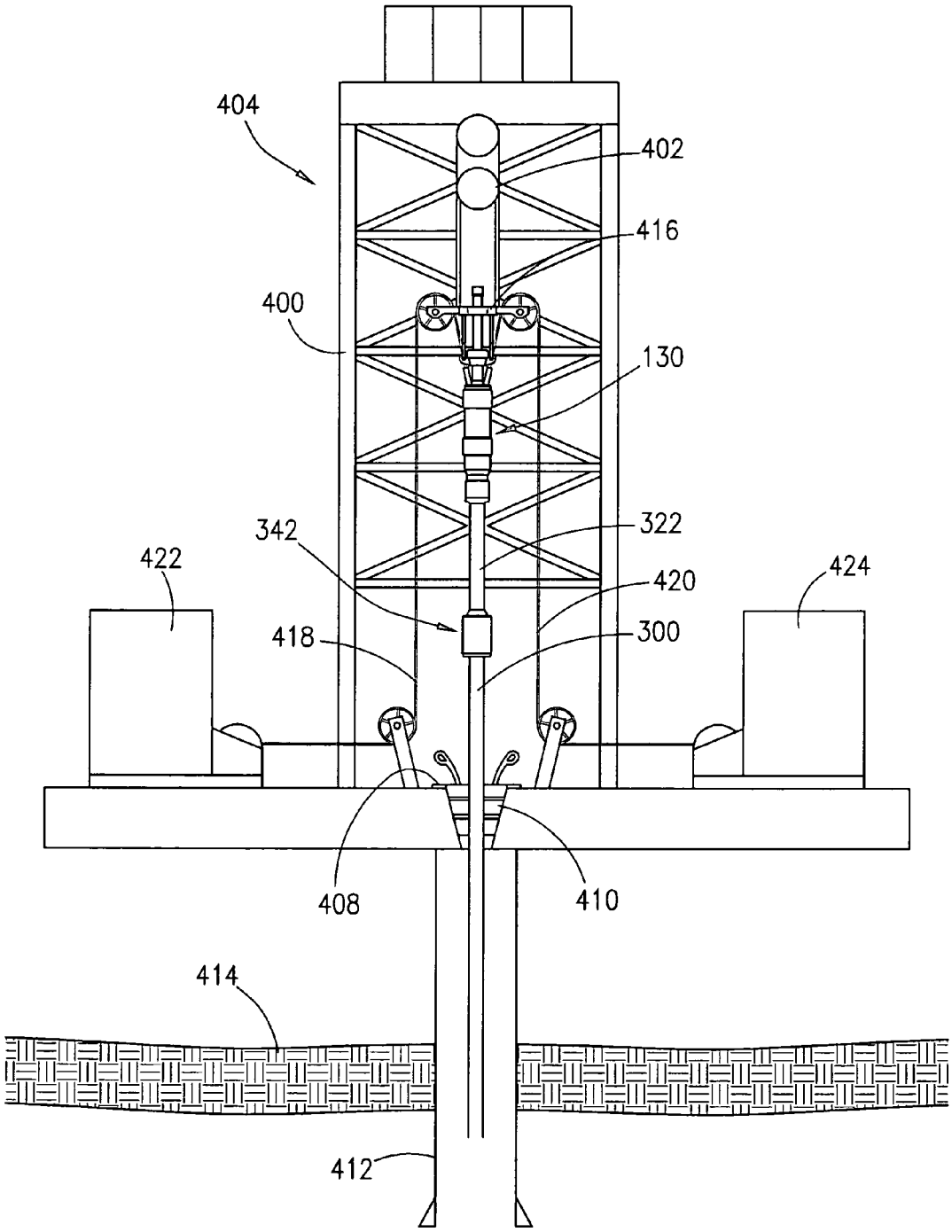
FIG. 8 is a schematic view of the most preferred embodiment of the present side entry apparatus being suspended from a derrick on a drilling rig.

Referring now to FIG. 8, a schematic of the tubular connector of the present invention being made-up on a drilling rig 400 will now be described. A block means 402 is suspended in the derrick 404 and the side entry apparatus 130 is suspended there from, with the tubular 322 extending there from. The second tubular 300 is shown within a rotary table 408 on the rig floor. The second tubular 300 is supported within the rotary table 408 via slip means 410 well known in the art. A casing string 412 extends below the surface into a subterranean zone 414. The second tubular 300 has the outer threads as previously described.

As noted earlier, FIG. 8 also depicts the tubular 322 that is suspended from block 402 and connected via elevators 416. The tubular 322 that is suspended from the block 402 has associated therewith the outer nut 342 (also referred to as the outer shell 342) with inner threads, as previously described. Hence, FIG. 8 depicts the side entry apparatus 130 that is hung off the elevators with the associated sheaves. As shown, two wirelines are employed, namely 418, 420, and wherein the two wireline enter the side entry apparatus 130 through the dual passages as per the teachings of the present invention. The wireline units 422, 424 are shown. Also, the connection between the tubular 322 and tubular 300 may be broken (i.e. not made up) so that an operator may perform operations such as replacing the downhole tools on one or both the wirelines as per the teachings of this invention. In other words, with the apparatus 130 as shown in FIG. 8, an operator is able to perform procedures and methods not possible with prior art designs due to the ability to make-up and break down the tubular connection at the rotary table. As noted earlier, it is possible to rig-up to one of the passages of the side entry apparatus 130 a kill line for pumping a fluid into the well i.e. a kill line is connected to the side entry apparatus 130 in place of wireline 418, in which case line 418 represents a conduit for delivery of the kill fluid while the apparatus 130 is holding the tubular string weight.

As many possible embodiments may be made of the tool of this invention without departing from the scope thereof, or any equivalents thereof, it is to be understood that all matters herein set forth or shown in the accompanying drawings are to be interpreted as illustrated and not in a limiting sense.

I claim:

1. A method of performing wireline work on a rig, wherein a well extends from the rig, and wherein the method comprises:

providing an apparatus comprising: a sleeve having a first end and a second end, wherein said first end contains a first plurality of wedges and the second end contains a second plurality of wedges; an upper mandrel having a third plurality of wedges that are configured to engage the first plurality of wedges wherein said upper mandrel contains a first passage and a second passage, and wherein said first passage is configured to receive the wireline; a first sub configured to engage the upper mandrel and the sleeve; a lower mandrel having a fourth plurality of wedges that engage with the second plurality of wedges; a second sub configured to engage the lower mandrel;

providing a wireline through said first passage and into a central bore of said sleeve, and wherein said wireline has a down hole tool attached at a first end, wherein the down hole tool is in the well;

lowering the down hole tool on the wireline into the well;

transmitting a torque to the upper mandrel;

transmitting the torque to the third plurality of wedges on said upper mandrel;

transferring the torque to the first plurality of wedges on said sleeve.

2. The method of claim 1 further comprising:

terminating the torque to the upper mandrel;

transmitting the torque to the lower mandrel;

transmitting the torque to the fourth plurality of wedges on said lower mandrel;

transferring the torque to the second plurality of wedges on said sleeve.

3. The method of claim 2 further comprising:

pumping a kill fluid through the second passage and into the well.

* * * * *